US005629667A

United States Patent [19]

Nyberg

[11] Patent Number: 5,629,667

[45] Date of Patent: May 13, 1997

[54] DIRECTION INDICATOR CIRCUIT

[76] Inventor: Lindley V. Nyberg, 4368 Strawberry Park Dr., San Jose, Calif. 95129

[21] Appl. No.: 493,645

[22] Filed: Jun. 22, 1995

[51] Int. Cl.[6] ..... G08B 5/16

[52] U.S. Cl. ..... 340/330; 340/328; 340/528; 340/556; 250/221

[58] Field of Search ..... 340/330, 328, 340/326, 327, 528, 545, 555, 556; 250/221

[56] References Cited

U.S. PATENT DOCUMENTS

| | | | |
|---|---|---|---|
| 3,852,592 | 12/1974 | Scoville et al. | 340/555 |
| 4,272,762 | 6/1981 | Geller et al. | 340/556 |
| 4,434,363 | 2/1984 | Yorifuji et al. | 340/556 |
| 5,021,644 | 6/1991 | Beran et al. | 340/555 |

*Primary Examiner*—Jeffery Hofsass
*Assistant Examiner*—Daniel J. Wu
*Attorney, Agent, or Firm*—David Volk; Brendan B. Dix

[57] ABSTRACT

The present invention relates to an electrical circuit for use in an alarm system. The circuit and alarm system being in electrical communication with an electrical power source. The alarm system has a detector configured to generate a first signal and a second signal in response to triggering by an individual. The alarm system further has an announcer adapted to produce an IN announcement in response to an IN signal and an OUT announcement in response to an OUT signal. The circuit comprises a first circuit portion which is responsive to the first signal for generating the IN signal to activate the announcer; and a second circuit portion which is responsive to the second signal for generating the OUT signal to activate the announcer.

8 Claims, 2 Drawing Sheets

DIRECTION INDICATOR CIRCUIT

BACKGROUND OF THE INVENTION

1. Field of the Invention

The present invention relates to alarm and sensor systems. More particularly, the present invention relates to a electrical circuit for use with doorways and gates which provides direction information to an alarm or announcer.

2. Description of the Prior Art

A variety of security devices have been employed at doorways and other ports which sound an alarm when activated by presence of an individual. An example of such an alarm is a sensor pad disposed under a door mat, the sensor in electrical communication with an announcer. The announcer is often in the form of a bell, horn, light, or other indicating signal. Another example of an alarm are infrared emitters and receivers spaced on either side of the port. When the IR signal is interrupted by an individual located between the emitter and the receiver, a signal is generated which activates an announcer. Although these and other prior art alarm measures are effective in sensing movement of an individual through a port, they do not indicate whether the individual is coming or going.

Oftentimes, the store owner, security guard, or other "employee" is alone at the workplace. In a situation where the employee enters a backroom for example, the activation of an announcer does not inform the employee whether a customer had just left, or a new customer(s) has just arrived. Unable to ascertain the presence of individuals from the announcer alone, the employee is subject to deception by a criminal. It would be highly desirable, therefore, to have an alarm system incorporating circuitry which can detect and announce the direction in which an individual is moving about the port or doorway.

Numerous innovations for alarm systems and circuitry have been provided in the prior an that are adapted to be used. Even though these innovations may be suitable for the specific individual purposes to which they address, they would not be suitable for the purposes of the present invention as heretofore described.

SUMMARY OF THE INVENTION

The present invention relates to an electrical circuit for use in an alarm system. The circuit and alarm system being in electrical communication with an electrical power source. The alarm system has a detector configured to generate a first signal in response to triggering by an individual or other body. The alarm system further has an announcer adapted to produce an IN announcement in response to an IN signal and an OUT announcement in response to an OUT signal. The circuit comprises a first circuit portion which is responsive to the first signal for generating the IN signal to activate the announcer; and a second circuit portion that is responsive to the second signal for generating the OUT signal to activate the announcer.

Accordingly, it is an object of the present invention to provide a circuit for use in an alarm system that can provide directional information to an announcer.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

BRIEF LIST OF REFERENCE NUMERALS UTILIZED IN THE DRAWING

10—circuit
VDC—electrical power source
SIG A—first signal
SIG B—second signal
CR 1—first protection diode
CR 2—second protection diode
R1—first relay
R2—second relay
R3—third relay
R4—fourth relay
R1*a*—contact
R1*b*—contact
R2*a*—contact
R2*b*—contact
SW1*a*—first manual reset switch
SW2*a*—second manual reset switch

BRIEF DESCRIPTION OF THE PREFERRED EMBODIMENT

DETAILED DESCRIPTION OF THE PREFERRED EMBODIMENT

Figure 1:
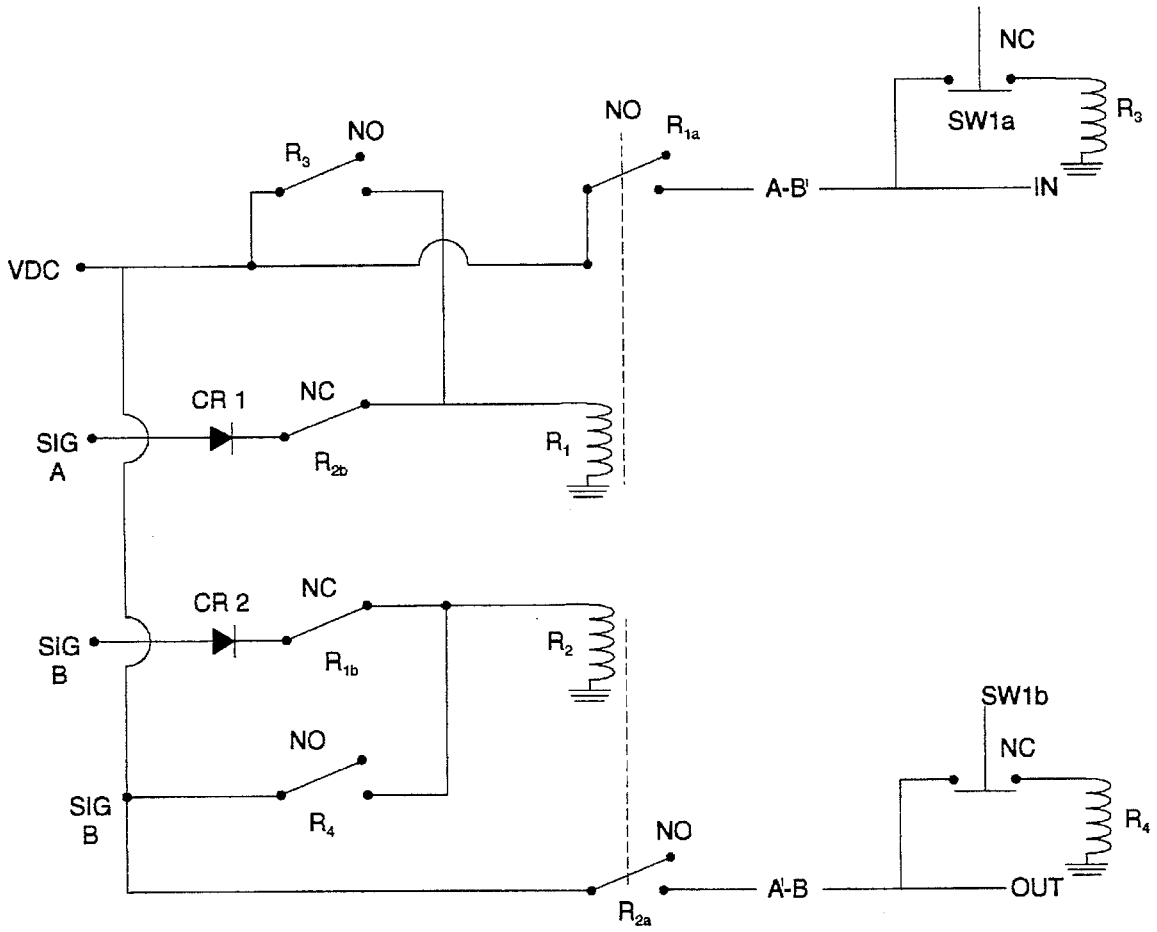
FIG. 1 is a plan view of a circuit constructed in accordance with the present invention.
Figure 2:
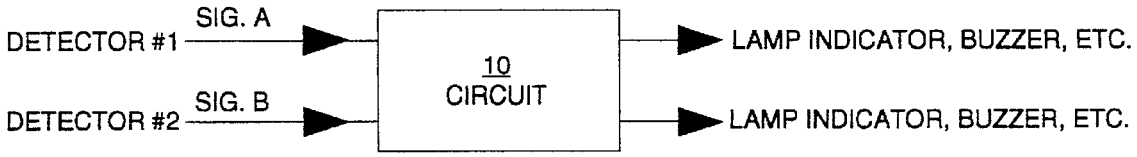
FIG. 2 is a schematic diagram of the circuit of FIG. 1 incorporated into an alarm system.

Firstly, referring to FIG. 1 in conjunction with FIG. 2, circuit 10 is illustrated. Circuit 10 receives electrical power from electrical power source VDC and is adapted to respond to inputs from remote signal sources, the inputs being in the form of a first signal SIG A and a second signal SIG B. The first and second signals, SIG A and SIG B, are dc voltages that are on for a period of time sufficient to energize relays R1, R2, R3 and R4. For simplicity of circuitry, the relays may all be of the same voltage and current carrying capacity on relay contacts R1*a*, R1*b*, R2*a* and R2*b*.

Referring to FIG. 1, the operation and sequence of the circuit 10 will now be described. When the first signal SIG A is received first by the circuit 10, the first relay R1 is turned on closing contact R1*a* and opening contact R1*b*. A·B', hereinafter called IN, turns on the third relay R3 latching or holding the first relay R1 on. The opening of contact R1*b* prevents second signal SIG B from energizing the second relay R2 and further prevents the signal A'·B, hereinafter OUT, from occurring. The signal IN can now be used to activate an announcer, for example as seen in FIG. 2, to light up a lamp or sound a buzzer.

When the second signal SIG B is received first by the circuit 10, the second relay R2 is turned on, contact R2*a* is closed and contact R2*b* is opened. The OUT signal turns on the fourth relay R4 latching or holding the second relay R2 on. The opening of contact R2*b* prevents the first signal SIG A from energizing the first relay R1 and further prevents the signal IN from occurring. The OUT signal can now be used to announce, or again as shown in FIG. 2, light up a suitable on/off device such as a lamp or buzzer.

SW1*a* and SW2*a* are manual reset switches for the IN and OUT signals, respectively, which can be local at the alarm device or remote. It is contemplated that the reset switches be in the form of timed switches which automatically reset the circuit to a default or start up setting after a selected period of no manual attention to the alarm.

CR1 and CR2 are protection diodes which prevent the electrical power supply VDC from feeding back to the first and second signal sources after the third and fourth relays R3 and R4 close.

Figure 3:
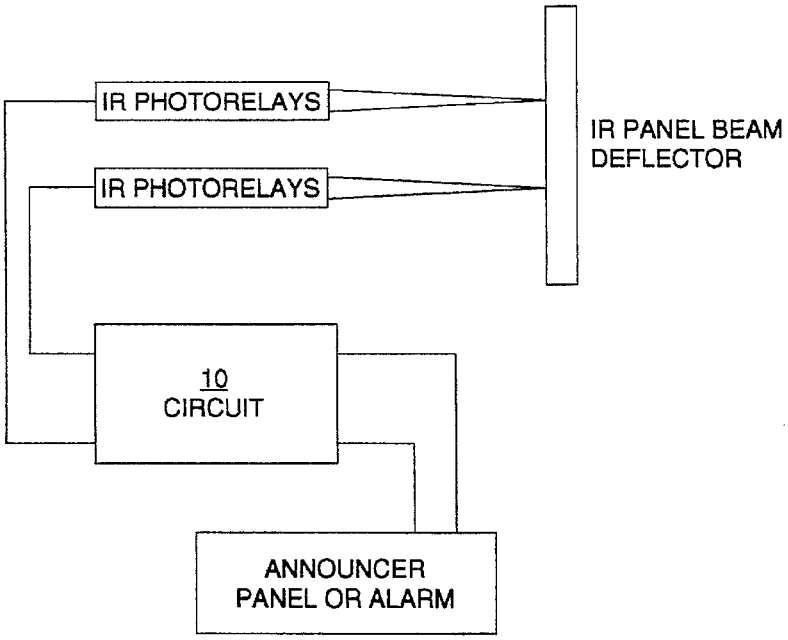
FIG. 3 is a schematic diagram of the circuit of FIG. 1 incorporated into an alarm system having infrared photo detectors.

Referring to FIG. 3, a schematic view of an exemplary alarm system is shown which incorporates circuit 10. In this alarm system the detector assembly includes infrared photorelays and an infrared beam deflector. A break in one infrared beam may generate a first signal while a break in the other infrared beam may generate a second signal. The first and second signals to be received by the circuit 10 which in turn produces an IN or an OUT signal to the announcer for appropriate announcement.

It will be understood that the circuit described above, or two or more together, may also find useful application in other types of alarm or sensor systems differing from the examples described above.

While the invention has been illustrated and described as embodied in a circuit for an alarm system, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. An electrical circuit for use in an alarm system, the circuit configured for electrical communication with an electrical power source, such an alarm system having a detector configured to generate a first signal and a second signal in response to triggering by a body, such an alarm system further having an announcer adapted to produce an IN announcement in response to an IN signal and an OUT announcement in response to an OUT signal, the circuit comprising:

a) first means responsive to such a first signal for generating the IN signal to activate such an announcer;

b) second means responsive to such a second signal for generating the OUT signal to activate such an announcer; and c) switch means for resetting the circuit to a default setting; the switch means operated externally of the circuit and such an alarm system.

2. The circuit of claim 1, wherein the switch means is manually operated.

3. The circuit of claim 1, wherein the switch means includes two switches.

4. The circuit of claim 3, wherein the two switches are manually operated.

5. An electrical circuit for use in an alarm system, the circuit and alarm system in electrical communication with an electrical power source, the alarm system having a detector configured to generate a first signal and a second signal in response to triggering by an individual, the alarm system further having an announcer adapted to produce an IN announcement in response to an IN signal and an OUT announcement in response to an OUT signal, the circuit comprising:

a) first means responsive to the first signal for generating the IN signal to activate the announcer;

b) second means responsive to the second signal for generating the OUT signal to activate the announcer; and c) externally operated switch means for resetting the circuit to a default setting.

6. The circuit of claim 5, wherein the switch means is manually operated.

7. The circuit of claim 5, wherein the switch means includes two switches.

8. The circuit of claim 7, wherein the two switches are manually operated.

* * * * *